US005159901A

United States Patent [19]

Chonan

[11] Patent Number: 5,159,901

[45] Date of Patent: Nov. 3, 1992

[54] STRUCTURE FOR MOUNTING A WATER PUMP ON AN ENGINE

[75] Inventor: Mitsugi Chonan, Ibaragi, Japan

[73] Assignee: Fuji Jukogyo Kabushiki Kaisha, Tokyo, Japan

[21] Appl. No.: 839,096

[22] Filed: Feb. 20, 1992

[30] Foreign Application Priority Data

Mar. 8, 1991 [JP] Japan ..... 3-68747

[51] Int. Cl.[5] ..... F01P 5/10

[52] U.S. Cl. ..... 123/41.47; 123/185.3

[58] Field of Search ..... 123/41.44, 41.47, 185.3

[56] References Cited

U.S. PATENT DOCUMENTS 4,643,135 2/1987 Wünsche ..... 123/41.44

*Primary Examiner*—Noah P. Kamen

*Attorney, Agent, or Firm*—Martin A. Farber

[57] ABSTRACT

An engine has a water pump and a recoil starter. A recoil starter housing secured to the engine has a boss coaxial with a crankshaft of the engine. An impeller shaft of the water pump is connected to an end of the crankshaft, and is rotatably mounted on the boss of the recoil starter housing. The recoil starter is rotatably mounted on the boss of the housing.

3 Claims, 2 Drawing Sheets

STRUCTURE FOR MOUNTING A WATER PUMP ON AN ENGINE

BACKGROUND OF THE INVENTION

The present invention relates to a mounting structure of a water pump for an engine, and more particularly to a water pump used in the engine for a vehicle such as a snowmobile.

A conventional water pump is provided on the engine for circulating a coolant in a cooling system. Generally, the pump is driven by a driven pulley and a belt from a drive pulley mounted on a crankshaft of the engine.

FIG. 2 shows a mounting structure of the conventional water pump.

A magneto rotor 3 is securely mounted on a crankshaft 1 of an engine by a nut 2. An output member 6 of a recoil starter 5 is connected to the magneto rotor 3 with bolts 10 interposing a drive pulley 4 therebetween. A water pump 12 is secured to a cylinder block 11 of the engine. The water pump 12 has an impeller shaft 13 on which an impeller 18 is securely mounted. A driven pulley 15 of the water pump 12 is fixed on the impeller shaft 13 at the other end projected from the water pump 12. A V-belt 16 is provided between the pulleys 4 and 15. A safety cover 19 is secured to the cylinder block 11 to cover the driven pulley 15 and the belt 16.

When the crankshaft 1 rotates, rotating power is transmitted to the impeller shaft 13 through the drive pulley 4, the belt 16, and the pulley 15, so that the impeller 18 mounted on the impeller shaft 13 is rotated to feed the coolant in the cooling system.

In the structure, large tension of the belt 16 is exerted on the crankshaft 1 and the impeller shaft 13. Since the shafts 1 and 13 are cantilevered, the crankshaft 1 must have an unnecessary large diameter to bear the large tension. Furthermore, the cover 19 causes the size and weight of the engine to increase.

In order to solve these problems, the water pump 12 may be coaxially provided with the crankshaft 1. However, since the recoil starter 5 is also mounted on the crankshaft 1, the crankshaft 1 must be long. As a result, center of gravity of the crankshaft 1 comes to the side of the recoil starter 5, so that vibration of the crankshaft 1 may occur.

SUMMARY OF THE INVENTION

An object of the present invention is to provide a structure for mounting a water pump, which eliminates the above described disadvantages.

According to the present invention, there is provided the structure for mounting the water pump on an engine with a crankshaft having, a recoil starter with an impeller shaft connected to an end of the crankshaft through a coupling, and a recoil starter housing secured to the engine. The impeller shaft is rotatably mounted in a boss of the recoil starter housing, and the recoil starter is also rotatably mounted on the boss of the housing. Thus, the water pump and the recoil starter are coaxially installed on the crankshaft.

Therefore, the impeller shaft of the water pump and the recoil starter are supported at the boss of the recoil starter housing. Consequently, entire length of the axis of the engine is not increased.

The other objects and features of this invention will become understood from the following description with reference to the accompanying drawings.

DETAILED DESCRIPTION OF THE PREFERRED EMBODIMENT

Figure 1:
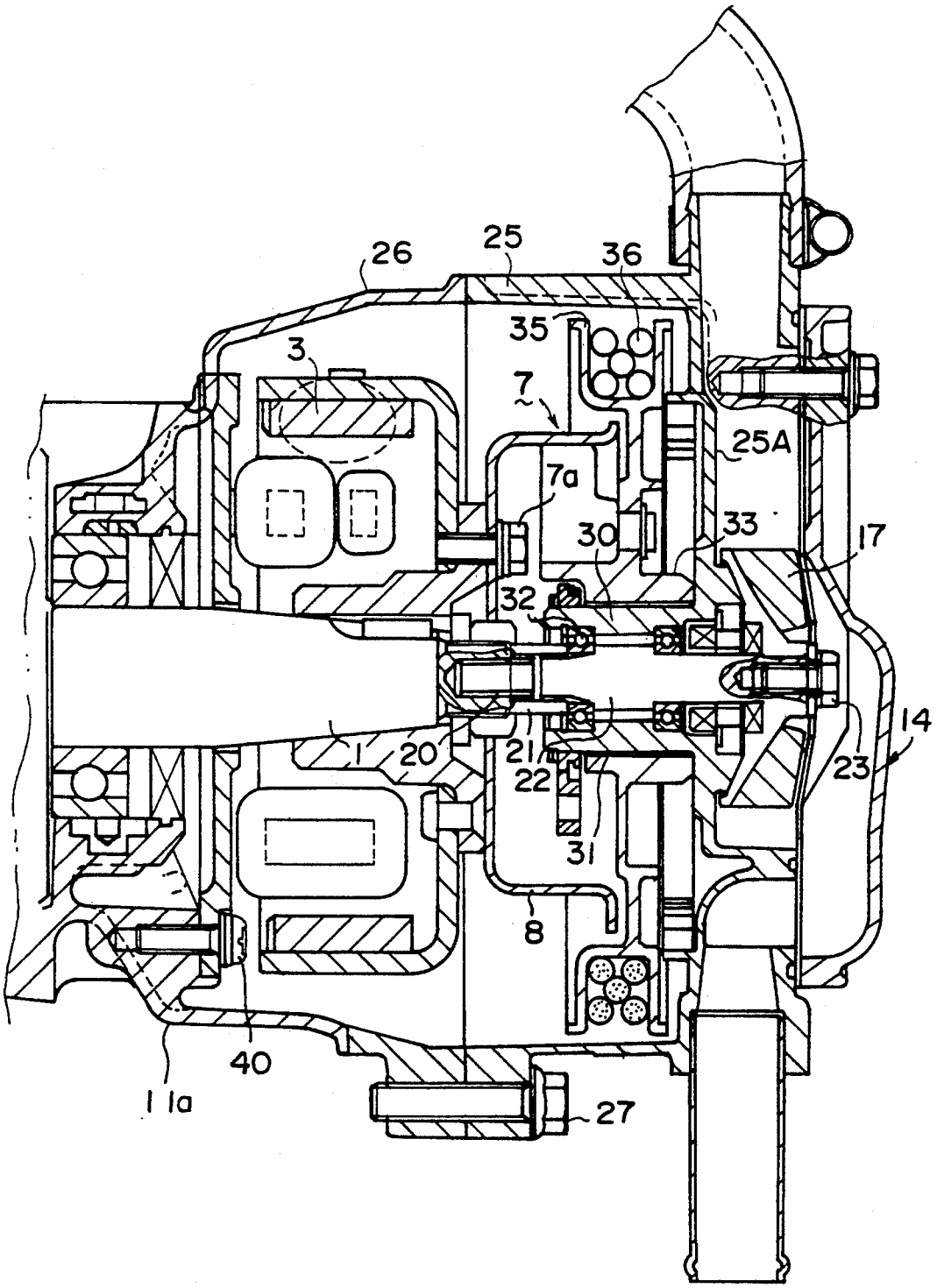
FIG. 1 is a sectional view showing a structure for mounting a water pump on an engine according to the present invention.

Referring to FIG. 1 showing a structure for mounting a water pump according to the present invention, a crankshaft 1 has a magneto rotor 3 mounted thereon in the same manner as the conventional one, and housed in a housing 26 which is secured to an engine block **11*a* by bolts 40**.

The crankshaft 1 has a pin 20 press-fitted in a bore formed in an end thereof. Another end of the pin 20 is splined and engaged with a coupling 21. A water pump 14 is coaxially arranged with the crankshaft 1. Namely, an end of impeller shaft 22 is splined and engaged with the coupling 21. Since the impeller shaft 22 is the coupling 21 by the spline, the shaft 22 is movable in axial direction.

A recoil starter 7 is also coaxially mounted on the crankshaft 1 in a housing 25. The housing 25 is secured to the magneto rotor housing 26 with bolts 27. The housing 25 has a vertical wall portion 25A and a boss 30. The impeller shaft 22 is rotatably supported in the boss 30 through a pair of bearings 32, so that the impeller shaft 22 is supported by a fixture member secured to the engine block **11*a*. The recoil starter 7 has an output member 8 secured to the magneto rotor 3 with bolts 7*a*, and a reel 35 having a rope 36 wound thereon. A hub 33 of the reel 35 is rotatably mounted on the boss 30 through a sleeve 31 made of fluoric synthetic resin or metal. The impeller 17 is secured to another end of the impeller shaft 22 with a bolt 23. The wall portion 25A houses the water pump 14**. Thus, the size of the structure can be reduced.

In operation, as the rope 36 is pulled to rotate the reel 35 on the boss 30, the magneto rotor 3 and the crankshaft 1 rotate. Consequently, the engine is started.

Figure 2:
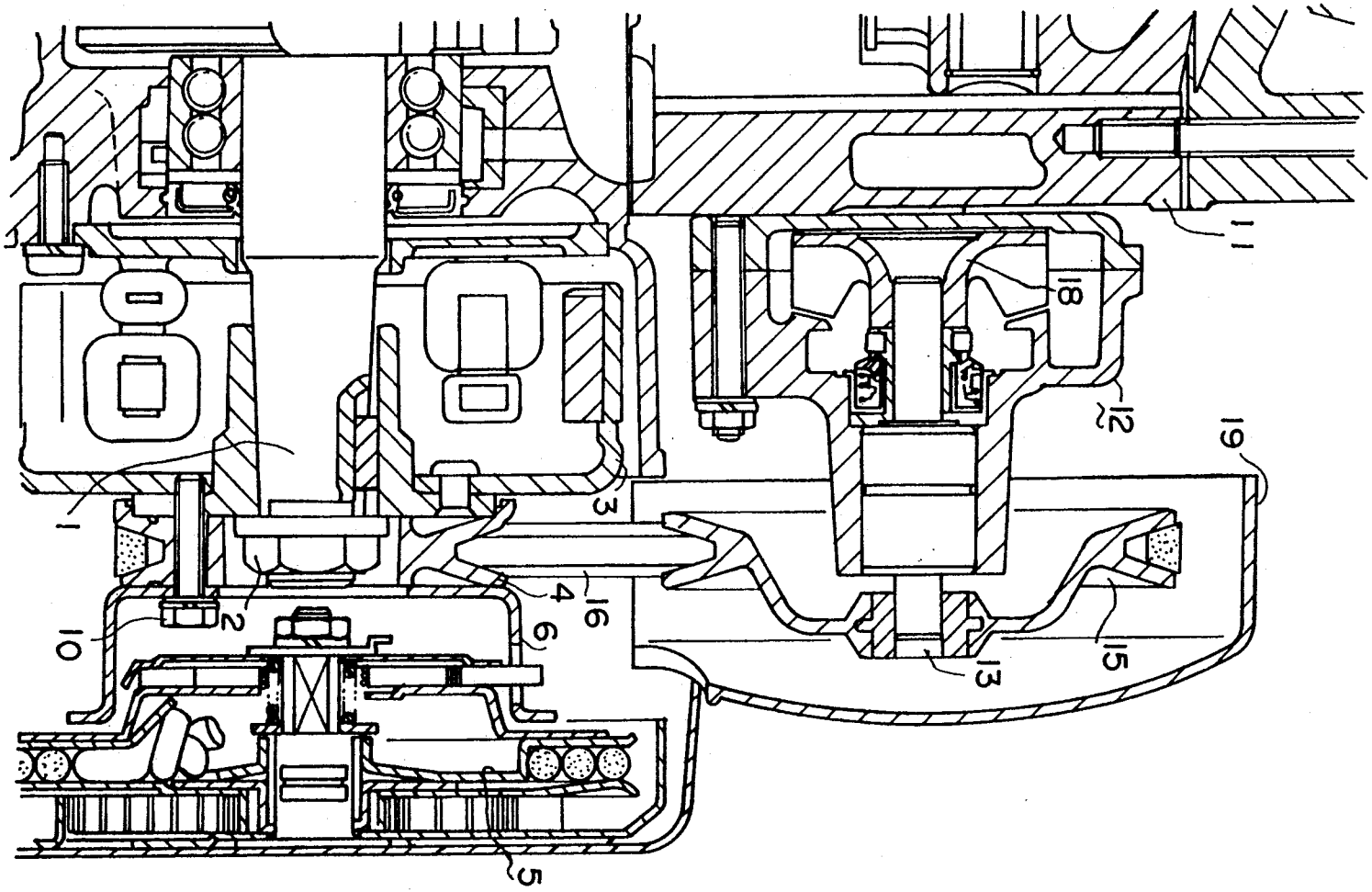
FIG.2 PRIOR ART
FIG. 2 is a sectional view showing a prior art of the structure.

In accordance with the present invention, as the impeller of the pump and the reel of the recoil starter are rotatably and coaxially mounted on the boss of the recoil starter housing, the axis length of the engine becomes short compared with the conventional engine of FIG. 2.

Furthermore, it is not necessary to provide the pulleys and V-belt for transmitting the rotating power of the crankshaft to the water pump, and hence a safety cover for the pulley and belt is not required. Thus, the energy loss caused by transmitting the power and the affect of the tension caused by the belt are eliminated, thereby reducing the diameter of the crankshaft.

While the presently preferred embodiment of the present invention has been shown and described, it is to be understood that this disclosure is for the purpose of illustration and that various changes and modifications may be made without departing from the scope of the invention as set forth in the appended claims.

What is claimed is:

1. A structure for mounting a water pump on an engine having a crankshaft and a recoil starter, said water pump having an impeller shaft, an improvement of the structure which comprises:

a recoil starter housing secured to said engine;

a cylindrical boss formed on the recoil starter housing coaxially with the crankshaft;

said impeller shaft of said water pump being connected to an end of said crankshaft, and being rotatably mounted in said boss of said recoil starter housing; and said recoil starter being rotatably mounted on said boss.

2. The structure according to claim 1, wherein said impeller shaft is connected to said engine through a coupling.

3. The structure according to claim 1, further comprising a part of said recoil starter housing is used for forming a part of a housing of said water pump.

* * * * *